US008292338B1

(12) United States Patent
Baghdasaryan

(10) Patent No.: US 8,292,338 B1
(45) Date of Patent: Oct. 23, 2012

(54) HAND OPERABLE SCOOPER

(76) Inventor: Hovhannes Hovik Baghdasaryan, Glendale, CA (US)

( * ) Notice: Subject to any disclaimer, the term of this patent is extended or adjusted under 35 U.S.C. 154(b) by 330 days.

(21) Appl. No.: 12/717,926

(22) Filed: Mar. 4, 2010

(51) Int. Cl.
*A01K 29/00* (2006.01)
*B25B 9/02* (2006.01)

(52) U.S. Cl. ..... 294/1.3; 294/25

(58) Field of Classification Search ..... 294/1.3–1.5, 294/25, 176; 15/257.1, 257.6; 383/1; 229/117.03, 229/117.09, 117.13, 198.1; D30/162
See application file for complete search history.

(56) References Cited

U.S. PATENT DOCUMENTS 3,407,927 A * 10/1968 Jones ..... 206/372
3,685,088 A * 8/1972 Doherty ..... 294/1.3
4,188,055 A * 2/1980 Green ..... 294/1.3
4,747,633 A * 5/1988 Stacy ..... 294/1.3
5,359,840 A * 11/1994 Costar ..... 294/25
5,725,268 A * 3/1998 Besasie et al. ..... 294/1.3
6,059,333 A * 5/2000 De Toma ..... 294/1.3
6,668,761 B2 * 12/2003 Tsigrik ..... 119/867
D613,006 S * 3/2010 Anderson ..... D30/162
7,862,094 B1 * 1/2011 Lamont et al. ..... 294/1.3
7,976,083 B2 * 7/2011 Black et al. ..... 294/1.3
2004/0222650 A1 * 11/2004 Colesanti et al. ..... 294/1.3
2009/0261603 A1 * 10/2009 Boghozian ..... 294/1.3
2009/0315349 A1 * 12/2009 Black et al. ..... 294/1.3

* cited by examiner

*Primary Examiner* — Paul T Chin
(74) *Attorney, Agent, or Firm* — Roy L Anderson; Wagner, Anderson & Bright, P.C.

(57) ABSTRACT

A scooper operable by movement of a hand or hands in which a dowel is held between outer and inner scoops pivotally connected about the dowel, each scoop having a front wall extending from a base such that the scoops form a jaw for picking up an object held inside the scoops in a closed position and movement of the scoops relative to each other are controlled by opposition of a thumb and at least one finger of the hand.

20 Claims, 5 Drawing Sheets

HAND OPERABLE SCOOPER

FIELD OF THE INVENTION

The present invention is in the field of hand-operable scoops useful for picking up objects from the ground.

BACKGROUND OF THE INVENTION

Dog owners who walk dogs on a leash are often faced with a situation in which their dog has left solid excrement along the path of the walk. In many cities there are laws requiring pet owners to pick up pet excrement. A common method of dealing with such excrement is to carry one or more plastic bags that can be used to gather pet excrement. However, this is still distasteful to many people. Accordingly, what is needed is an apparatus useful for picking up dog or pet excrement from the ground that is clean, convenient, inexpensive and easy to use.

SUMMARY OF THE INVENTION

The present invention is generally directed to an apparatus operable by movement of a hand in which a dowel is held between outer and inner plastic scoops pivotally connected about the dowel, each scoop having a front wall extending from a base such that the scoops form a jaw for picking up an object held inside the scoops in a closed position and movement of the scoops relative to each other are controlled by opposition of a thumb and at least one finger of the hand.

In a first, separate group of aspects of the present invention, the scoops have outer side walls with openings for holding the dowel along with protrusions for connecting the side walls of the scoops.

In a second, separate group of aspects of the present invention, the base walls have handles (which can be adjustable) that can be made from straps, rubber, and the like threaded through openings in the base walls which are then fastened together (e.g., through use of hook-and-loop fasteners). A separate strap can be secured to one of the ends of the dowel (which itself can be a fixed or adjustable fastener to hook).

Accordingly, it is a primary object of the present invention to provide an improved hand-operable scoop for picking up objects from the ground. This and further objects and advantages will be apparent to those skilled in the art in connection with the drawings and the detailed description of the invention set forth below.

DETAILED DESCRIPTION OF THE INVENTION

The present invention is generally directed to a hand-held scooper that is suitable for use in scooping up objects, such as a pet's excrement, inside a single use bag. The scooper is designed to be manually operated and capable of easy attachment to a belt or the like. It is operated by opposition of a thumb and at least one finger of the hand (and preferably four fingers) so that once a hand is inserted inside of its handle straps, opposition of fingers and the thumb easily causes the two jaws of the scoop to open and close, thus mimicking the motion of a hand that might otherwise pick up such objects. However, unlike simple use of a bag, the scooper insulates the hand from contact with the object and also helps to gather the object (such as excrement) together inside the scoop from which it can then easily be removed and closed.

The present invention will now be discussed in connection with a preferred embodiment illustrated in FIGS. 1-9.

In the Figures and the following more detailed description, numerals indicate various features of the invention, with like numerals referring to like features throughout both the drawings and the description. Although the Figures are described in greater detail below, the following is a glossary of the elements identified in the Figures.

Figure 1:
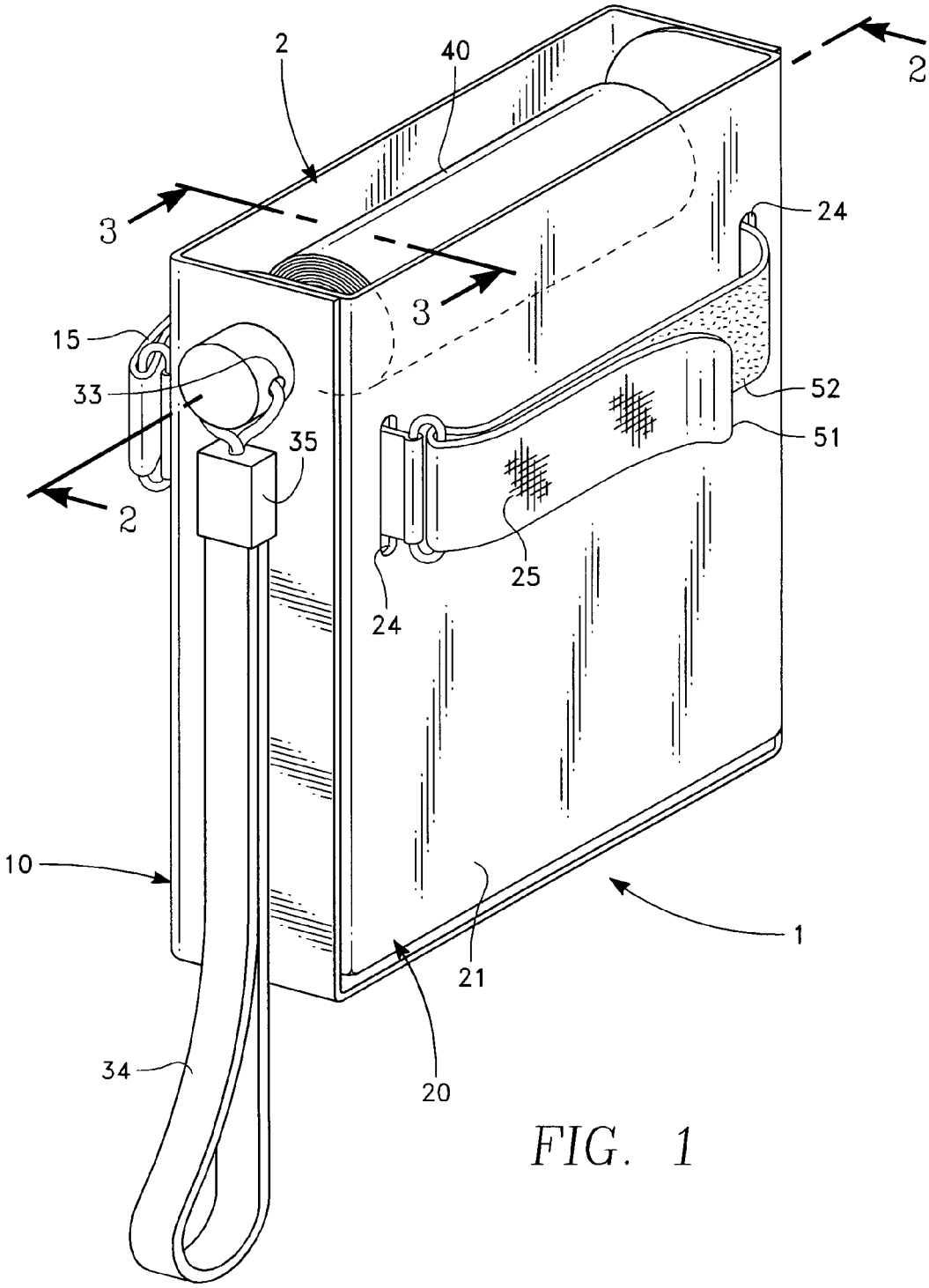
FIG. 1 illustrates a preferred embodiment of the present invention in a closed state.
Figure 2:
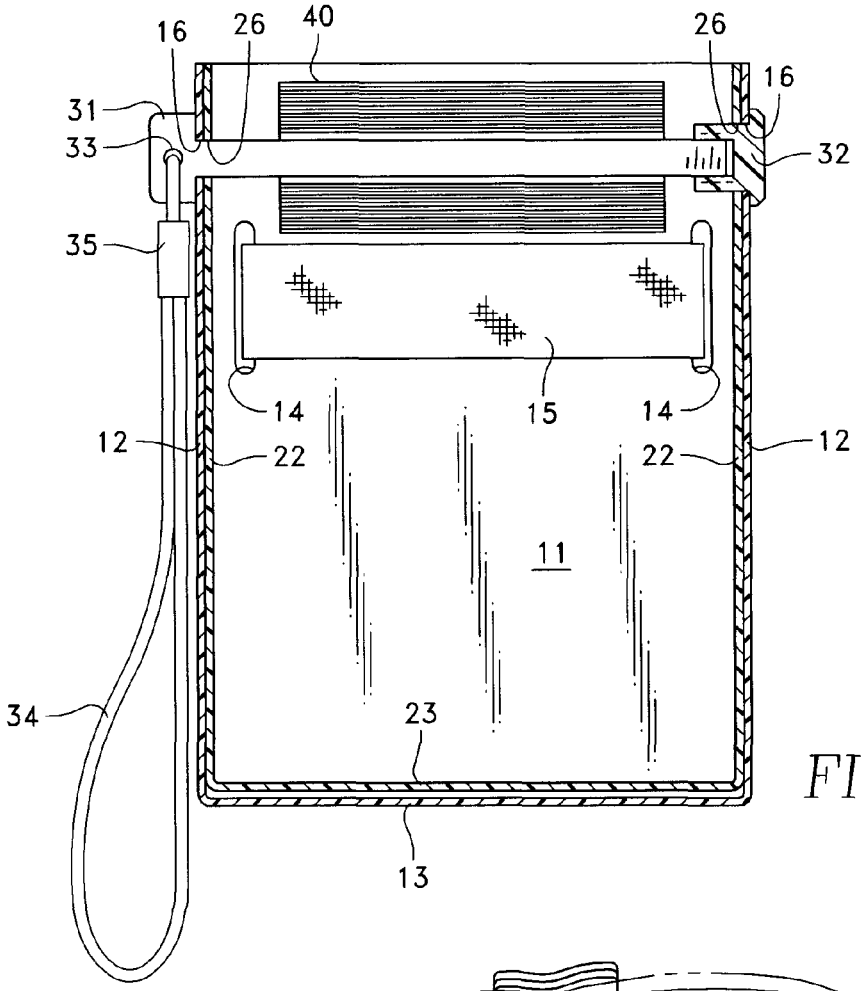
FIG. 2 illustrates a cross-sectional view taken along ling 2-2 of FIG. 1.
Figure 3:
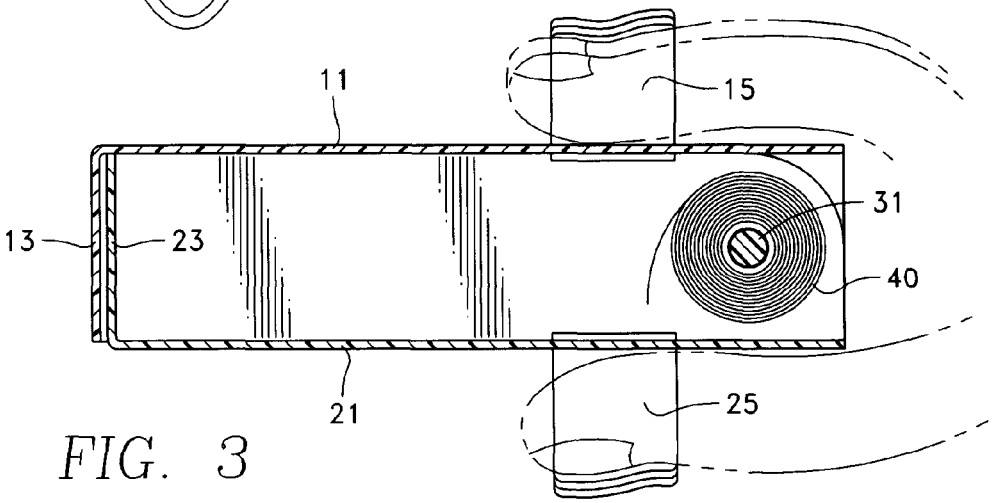
FIG. 3 illustrates a cross-sectional view of the embodiment of FIG. 1 with a user hand engaging the hand straps.
Figure 4:
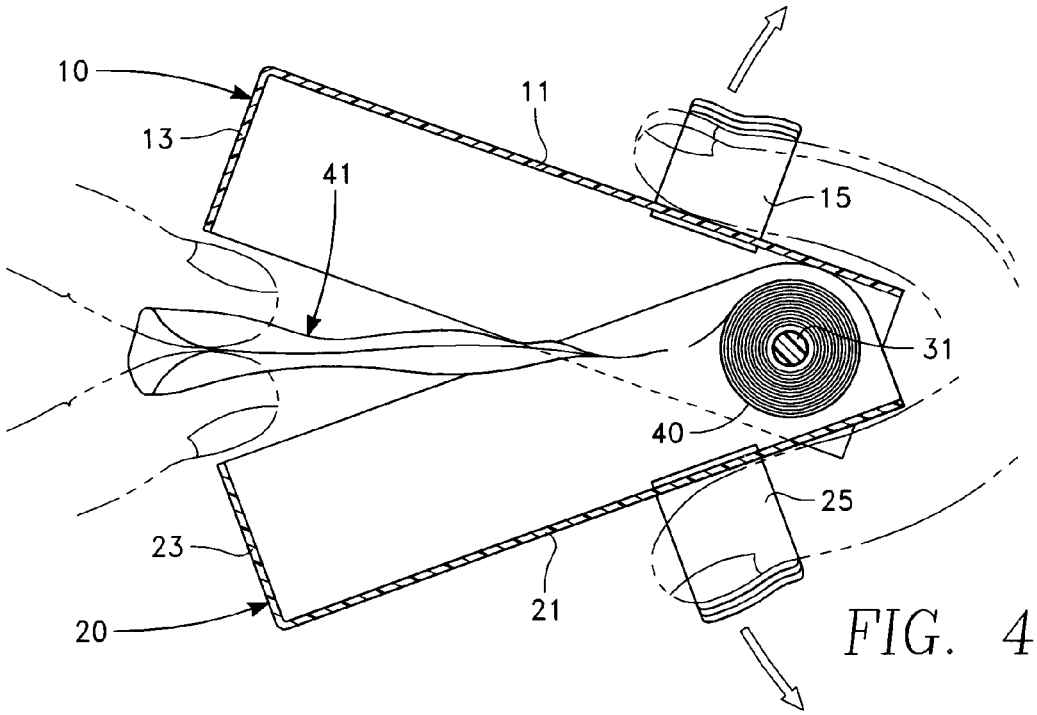
FIG. 4 illustrates the view of FIG. 3 as the user's hand causes the scooper to open by movement of the user's fingers in the directions indicated by the arrows of FIG. 4.
Figure 5:
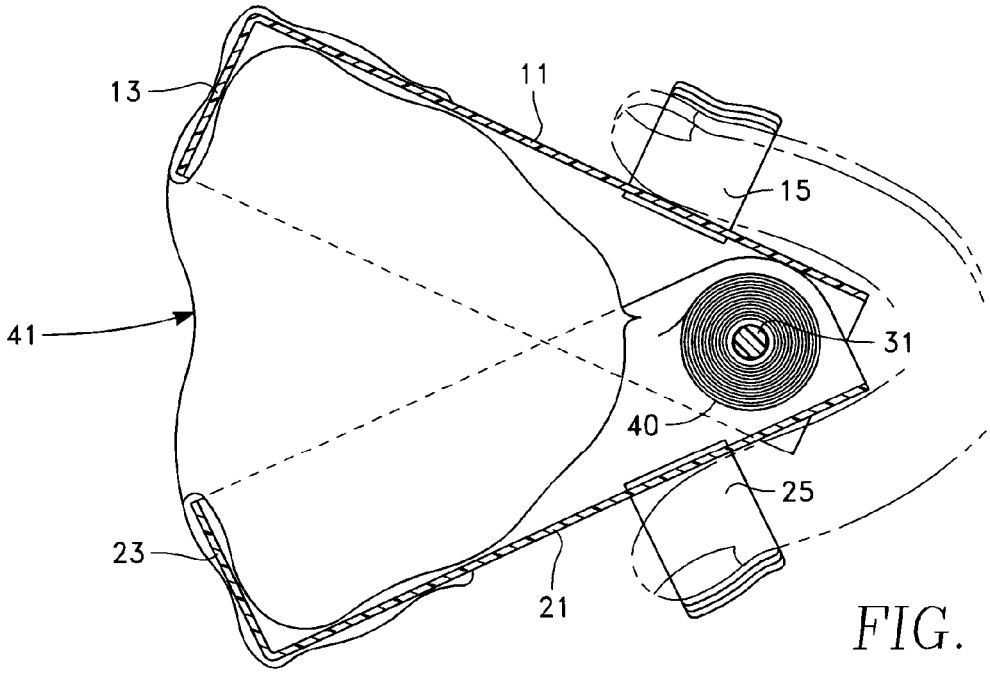
FIG. 5 illustrates the scooper of FIG. 4 after it has been further opened and a bag has been inserted into for use.

1 scooper, generally
2 back opening of scooper
10 outer scoop
11 outer scoop base wall
12 outer scoop side wall
13 outer scoop front wall
13 outer scoop opening
14 outer scoop base opening
15 outer scoop hand strap
16 outer scoop side opening
20 inner scoop
21 inner scoop base wall
22 inner scoop side wall
23 inner scoop front wall
23 inner scoop opening
24 inner scoop base opening
25 inner scoop hand strap
26 inner scoop side opening
31 dowel rod
32 dowel fastener
33 opening
34 strap
35 strap fastener
40 roll of bags
41 individual bag
51 hook-and-loop fastener strip (adjustable)
52 hook-and-loop fastener strip that mates to 51 (adjustable)
60 object to be scooped up in bag A scooper in accordance with a preferred embodiment of the present invention is shown generally as 1 in FIG. 1 in which it is in a closed position. Scooper 1 has an outer scoop 10 having a base wall 11, side walls 12, a front wall 13, base openings 14, side openings 16 and an adjustable hand strap 15 threaded through base openings 14. Scooper 1 also has an inner scoop 20 having a base wall 21, side walls 22, a front wall 23, base openings 24, side openings 26 and an adjustable hand strap 25 threaded through base openings 24. Hand straps 15 and 25 can, in an especially preferred embodiment, be made adjustable, and also opened and closed, through use of hook-and-loop fastener strips (e.g., Velcro® strips).

Outer and inner scoops 10 and 20 are, in an especially preferred embodiment, made of rigid plastic and can be snapped together when one of the side walls (of either the inner or the outer scoop) has a protrusion (preferably circular, and not shown) to snap into the opening (either 16 or 26) of the contingent side wall in a snap fit relationship. A dowel rod 31 is inserted through openings 16 and 26 of each of the side walls and provides a pivot point (unless circular protrusions from the snap fit provide a pivot point). The reason the scoops are made of a rigid material is so that a user's hand does not feel or have a feeling of contact with objects being picked up (as would be the case, e.g., if one were to simply use a paper or plastic bag). Although the scoops are preferably made of rigid plastic, they can also be made of a plastic material that is not rigid (i.e., something that can bend), so long as the scoops have sufficient structural integrity to form scoops and also, coupled with their thickness, to avoid allowing the user to have a feeling of contact with objects being picked up. The reason the scoops are made of plastic is so they do not collapse or rust upon coming into contact with wet surfaces, such as wet grass. Although it is believed that plastic is the preferred material for the scoops in view of its cost and ease of use with molds, any material that does not rust and does not suffer structural collapse upon contact with water (as would cardboard) can be deemed to be a "plastic" material within the meaning of this invention.

Dowel rod 31 has dowel fasteners 32 on each of its ends to hold it in place. Dowel fasteners 32 can each be removable, or just one of them can be removable, or, in its simplest form and for a disposable scooper 1, neither can be removable after assembly, although it is preferred that at one be removable so a replacement roll of bags 40 can be used with scooper 1. Dowel rod fasteners can, for example, be nuts that are fastened to a thread on the end of the dowel rod. It is especially preferred that a strap 34 be attached to a dowel fastener 32 that is not removable, and FIG. 1 illustrates how a strap fastener 35 can be threaded though an opening 33 in a dowel fastener 32. Strap 34 can be a common loop strap as shown in FIG. 1, or it can be a piton strap or some other convenient mechanism for attachment to a belt and the like so that scooper 1 can conveniently be carried by clothing or hung on a hand until it is needed.

A roll of bags 41, carried by dowel rod 31, provides a convenient source of single use bags for use. An individual bag 41 can be removed from a back opening of scooper 1 (see FIG. 1) or, when scooper 1 is opened, from between scoops 10 and 20 when they are in an open jaw configuration (see, e.g., FIG. 9).

Figure 7:
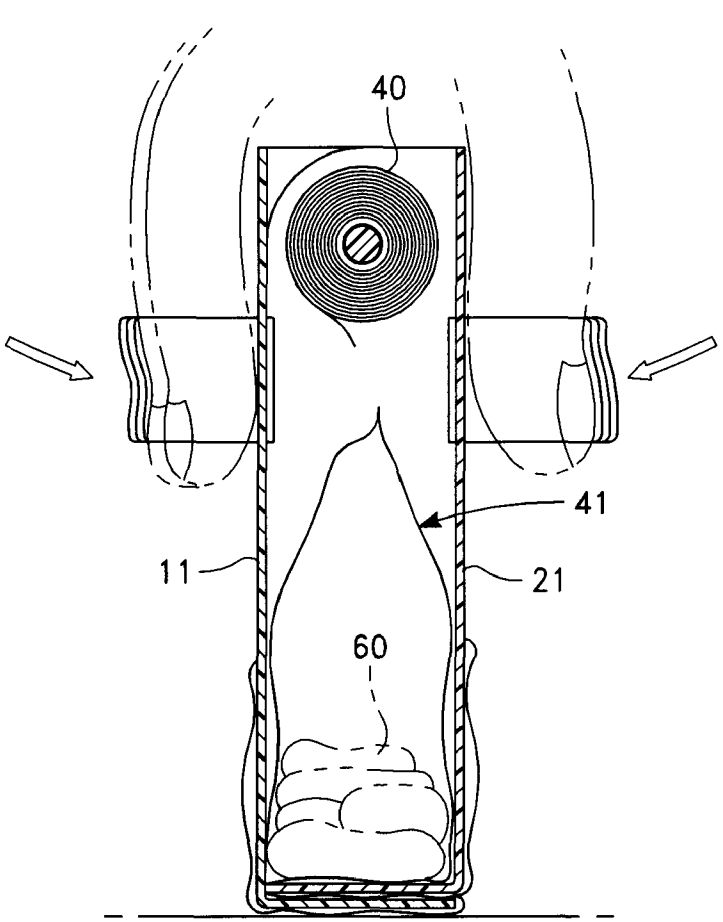
FIG. 7 illustrates the user from FIG. 6 after the scooper has been closed.
Figure 6:
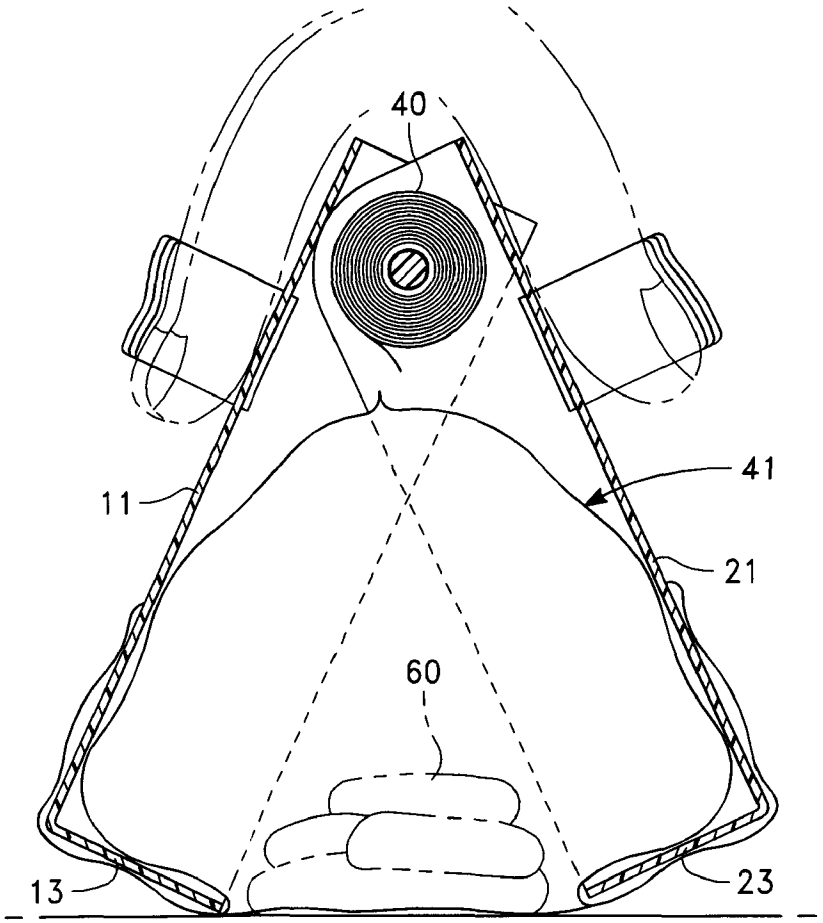
FIG. 6 illustrates a user in the process of beginning to scoop up an object with the scooper.
Figure 8:
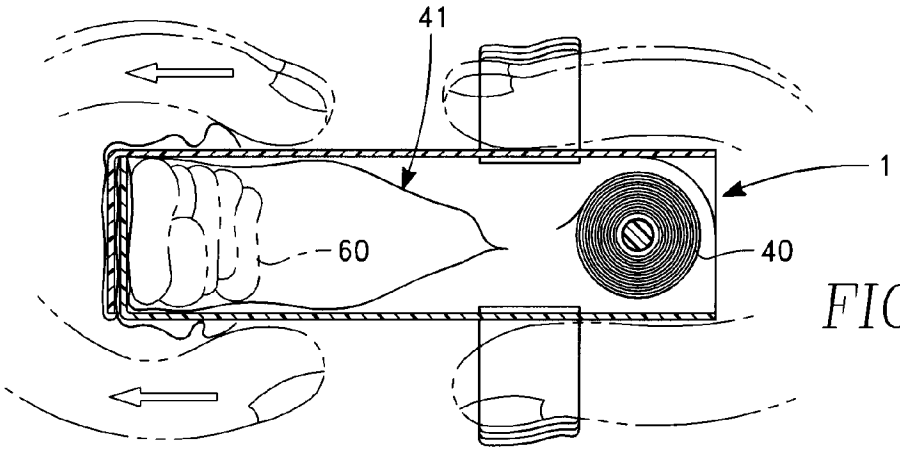
FIG. 8 illustrates the user from FIG. 7 after the bag has been gathered forward from the scoops so that the object being scooped up is now contained within the bag in the scooper.
Figure 9:
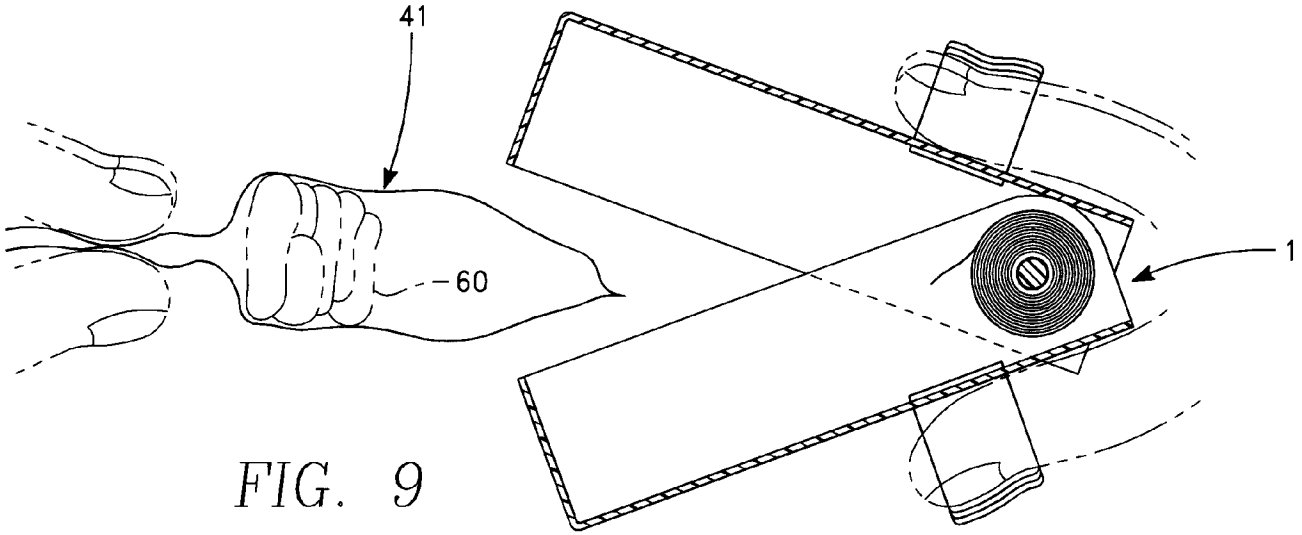
FIG. 9 illustrates the user removing the used bag with the scooped up object from the scooper.

Scooper 1 according the present invention provides a simple, economical and easy-to-use apparatus for scooping up objects 60 from the ground into an individual bag 41. In use an individual bag 41 is removed from roll of bags 40 and then secured around outer and inner scoops 10 and 20 (see FIG. 5). When a thumb is inserted into one of hand straps 15 and 25, and one to preferably four fingers are inserted in the other of hand straps 15 and 25, opposition of fingers and the thumb easily causes the two scoops 10 and 20 of scoop 1 to open and close in a jaw-like fashion, thus mimicking the motion of a hand that might otherwise pick up such objects, as depicted in FIGS. 6-8. Once object 60 has been scooped up inside of an individual bag 41 inside of scoop 1, scoop 1 can be oriented so that once it is opened individual bag 41 can be reversed off of scoops 10 and 20 and then sealed so that it is ready for disposal.

It should be noted that scooper 1 according to the present invention does not rely upon a spring to provide bias to either open or close outer and inner scoops 10 and 20. Instead, inner and outer scoops 10 and 20 are designed so that inner scoop 21 will easily fit inside of outer scoop 10 and present an efficient profile as shown in FIG. 1 that can easily be attached to a user's clothing, that can easily be retrieved, and that can easily be used. By not requiring any force to counter a spring, or any other mechanism that might be used to bias scoops 10 and 20 closed, use of scooper 1 is natural and intuitive in that it mimics one's use of one's own hand, yet with decided advantages. Such simplicity is critical because it promotes ease of use, low cost of manufacturing, and thus creates broader user appeal, since such scoops 1 could be sold at convenient locations or even easily vended from machines.

While the invention has been described herein with reference to certain preferred embodiments, those embodiments have been presented by way of example only, and not to limit the scope of the invention. For example, while hand straps 15 and 25 are described in the preferred embodiment as being threaded through slots 14 and 26, and as having hook-and-loop fastening strips, many other mechanisms and ways of attaching straps, whether they are adjustable or not, can be used, although it is believed they would not be as convenient and economical as what has been disclosed as a preferred embodiment. Additional embodiments and further modifications are also possible in alternative embodiments that will be obvious to those skilled in the art having the benefit of this detailed description.

Accordingly, still further changes and modifications in the actual concepts described herein can readily be made without departing from the spirit and scope of the disclosed inventions as defined by the following claims.

What is claimed is:

1. An apparatus operable by movement of a hand, comprising:

a dowel with at least one removable dowel fastener;

a rigid plastic outer scoop with an outer front wall extending from an outer base wall;

an inner rigid plastic scoop with an inner front wall extending from an inner base wall, said inner scoop being pivotally connected to the outer scoop about the dowel;

an outer base wall handle secured to the outer base wall; and an inner base wall handle secured to the inner base wall;

wherein the inner scoop and the outer scoop form an overlapping jaw for picking up an object held in an inner space of the apparatus in a closed position and the inner scoop and the outer scoop open away from each other about the dowel as the apparatus moves from the closed position to an open position;

wherein an interior enclosure space is defined by the rigid plastic outer scoop and the inner rigid plastic scoop in the closed position in which the inner front wall is held substantially within said interior enclosure; and wherein movement of the outer base wall handle and the inner base wall handle relative to each other are controlled by opposition of a thumb and at least one finger of the hand such that the thumb and the at least one finger of the hand exert force on the inner rigid plastic scoop and the rigid plastic outer scoop toward each other as the apparatus moves from the open position to the closed position and the thumb and the at least one finger of the hand exert force on the outer base wall handle and the inner base wall handle as the apparatus moves from the closed position to the open position.

2. The apparatus of claim 1, further comprising a pair of outer side walls connected to the outer base wall.

3. The apparatus of claim 2, further comprising a pair of inner side walls connected to the inner base wall.

4. The apparatus of claim 3, further comprising an opposing pair of outer scoop openings formed in the pair of outer side walls and an opposing pair of inner scoop openings formed in the pair of inner side walls, said dowel being held in said opposing pairs of outer and inner scoop openings.

5. The apparatus of claim 4, further comprising a pair of opposing protrusions for connecting the pair of outer side walls to the pair of inner side walls and forming a pair of pivots.

6. The apparatus of claim 5, wherein the dowel extends through the pair of pivots.

7. The apparatus of claim 6, wherein at least one of the outer base wall handle and the inner base wall handles are adjustable.

8. The apparatus of claim 6, wherein said at least one removable dowel fastener is comprised of a first removable dowel fastener and a second dowel fastener, said first and second dowel fasteners holding the dowel in a fixed position in the apparatus in a closed dowel state.

9. The apparatus of claim 8, wherein the second dowel fastener is not removably affixed to an end of the dowel.

10. The apparatus of claim 8, further comprising a strap secured to the second dowel fastener.

11. The apparatus of claim 8, further comprising a strap secured to the first dowel fastener.

12. The apparatus of claim 1, wherein the outer base wall handle is secured to the outer base wall by a pair of slots in the outer base wall and an outer base wall handle fastener, said outer base wall handle being threaded through said pair of slots.

13. An apparatus operable by opposition of a thumb and at least one finger of a hand, comprising:

a dowel having a first end with a first dowel fastener affixed to it and a second end with a second dowel fastener affixed to it;

an outer rigid plastic scoop having an outer base wall, two outer side walls and an outer front wall extending from the outer base wall;

an inner rigid plastic scoop having an inner base wall, two inner side walls and an inner front wall extending from the inner base wall;

an outer base wall handle secured to the outer base wall; and an inner base wall handle secured to the inner base wall;

wherein the inner scoop and the outer scoop form an overlapping jaw for picking up an object held in an inner space of the apparatus in a closed position and the inner scoop and the outer scoop open away from each other about the dowel as the apparatus moves from the closed position to an open position;

wherein the inner side walls and the inner front wall fit within the outer side walls and the outer front wall in the closed position; and wherein movement of the outer base wall handle and the inner base wall handle relative to each other are controlled by opposition of a thumb and at least one finger of the hand such that the thumb and the at least one finger of the hand exert force on the inner rigid plastic scoop and the rigid plastic outer scoop toward each other as the apparatus moves from the open position to the closed position and the thumb and the at least one finger of the hand exert force on the outer base wall handle and the inner base wall handle as the apparatus moves from the closed position to the open position.

14. The apparatus of claim 13, further comprising a pair of opposing protrusions for connecting the pair of outer side walls to the pair of inner side walls and forming a pair of pivots.

15. The apparatus of claim 14, wherein the dowel extends through the pair of pivots.

16. The apparatus of claim 15, wherein the outer base wall handle and the inner base wall handles are adjustable.

17. The apparatus of claim 16, one of the first and second dowel fasteners is not removably affixed to the dowel.

18. The apparatus of claim 17, further comprising a strap secured to one of the pair of dowel fasteners.

19. An apparatus, comprising:

a dowel with at least one removable dowel fastener;

a rigid outer scoop with an outer front wall extending from an outer base wall and a pair of opposing side walls connected to the outer base wall so as to form an outer scoop inner open area;

an inner rigid scoop with an inner front wall extending from an inner base wall, said inner scoop being pivotally connected to the outer scoop about the dowel;

an outer base wall handle secured to the outer base wall; and an inner base wall handle secured to the inner base wall;

wherein the inner scoop and the outer scoop form an interlocking jaw for picking up an object held in an inner space of the apparatus in a closed position and the inner scoop and the outer scoop open away from each other about the dowel as the apparatus moves from the closed position to an open position, the inner front wall being held substantially within the outer scoop inner open area in the closed position; and wherein movement of the outer base wall handle and the inner base wall handle relative to each other are controlled by opposition of a thumb and at least one finger of the hand exerting force on the inner rigid scoop and the rigid outer scoop toward each other as the apparatus moves from the open position to the closed position and the thumb and the at least one finger of the hand exert force on the outer base wall handle and the inner base wall handle as the apparatus moves from the closed position to the open position.

20. The apparatus of claim 19, wherein at least one of the outer base wall handle and the inner base wall handles are adjustable.

* * * * *